US008904975B2

(12) United States Patent
Ikeda et al.

(10) Patent No.: US 8,904,975 B2
(45) Date of Patent: Dec. 9, 2014

(54) CYLINDER HEAD OF INTERNAL COMBUSTION ENGINE

(75) Inventors: Akihiro Ikeda, Nagoya (JP); Tsutomu Wakiya, Toyota (JP); Hideo Nakamura, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/110,606

(22) PCT Filed: Apr. 11, 2011

(86) PCT No.: PCT/JP2011/059024

§ 371 (c)(1), (2), (4) Date: Oct. 8, 2013

(87) PCT Pub. No.: WO2012/140722

PCT Pub. Date: Oct. 18, 2012

(65) Prior Publication Data

US 2014/0076262 A1 Mar. 20, 2014

(51) Int. Cl.

| | |
|---|---|
| ***F02F 1/40*** | (2006.01) |
| ***F02F 1/24*** | (2006.01) |
| ***F02F 1/42*** | (2006.01) |
| ***F02F 1/38*** | (2006.01) |

(52) U.S. Cl.

CPC ... *F02F 1/24* (2013.01); *F02F 1/40* (2013.01); *F02F 1/242* (2013.01); *F02F 1/4214* (2013.01); *F02F 1/38* (2013.01)

USPC ..... 123/41.82 R; 123/193.1

(58) Field of Classification Search

CPC ..... F02F 1/243; F02F 1/24; F02F 1/242; F02F 1/02; F01P 2003/021; F01P 3/00

USPC ..... 123/193.3, 193.1, 193.2, 193.4, 41.82 R, 123/41.82 A, 41.81

See application file for complete search history.

(56) References Cited

U.S. PATENT DOCUMENTS

| | | | | |
|---|---|---|---|---|
| 1,338,342 | A * | 4/1920 | Horning | 123/41.77 |
| 6,981,473 | B2 * | 1/2006 | Gunji et al. | 123/41.82 R |
| 7,069,885 | B2 * | 7/2006 | Iida | 123/41.82 R |
| 7,520,257 | B2 * | 4/2009 | Adams et al. | 123/193.5 |
| 2002/0124815 | A1 | 9/2002 | Ishiguro et al. | |
| 2005/0145204 | A1 * | 7/2005 | Iida | 123/41.31 |
| 2005/0205024 | A1 * | 9/2005 | Yamada | 123/41.82 R |

FOREIGN PATENT DOCUMENTS

| | | | |
|---|---|---|---|
| JP | 2000-310157 | A | 11/2000 |
| JP | 3280489 | B2 | 5/2002 |
| JP | 2002-256966 | A | 9/2002 |
| JP | 2004-218481 | A | 8/2004 |
| JP | 2009-197725 | A | 9/2009 |
| JP | 2009-264260 | A | 11/2009 |
| JP | 4375261 | B2 | 12/2009 |

* cited by examiner

*Primary Examiner* — Noah Kamen
*Assistant Examiner* — Long T Tran
(74) *Attorney, Agent, or Firm* — Sughrue Mion, PLLC

(57) ABSTRACT

A cylinder head (1) includes a water jacket (4) formed around an ignition plug mounting hole (5). Upper surfaces (12 to 14) of portions of the water jacket (4) between intake ports (7) and the ignition plug mounting hole (5) and between exhaust ports (8) and the ignition plug mounting hole (5) are set to be lower than upper surfaces (15 to 17) of the remaining portions of the water jacket (4) around the ignition plug mounting hole (5) to increase the rigidity. Thereby, deformation of the cylinder head (1) due to cylinder internal pressure is limited, and the stress concentration around the ignition plug mounting hole (5) due to such deformation is reduced.

2 Claims, 5 Drawing Sheets

CYLINDER HEAD OF INTERNAL COMBUSTION ENGINE

CROSS REFERENCE TO RELATED APPLICATIONS

This application is a National Stage of International Application No. PCT/JP2011/059024, filed on Apr. 11, 2011, the contents of all of which are incorporated herein by reference in their entirety.

TECHNICAL FIELD

The present invention relates to a cylinder head for an internal combustion engine including an intake port, an exhaust port, a mounting hole for mounting a member to be cooled, and a water jacket provided around the mounting hole.

BACKGROUND ART

As publicly known, a cylinder head for an internal combustion engine is provided with an intake port, an exhaust port, and a water jacket located around an ignition plug mounting hole between an upper deck and a lower deck. The cylinder head is cooled by cooling water that flows through the water jacket.

Conventionally, Patent Document 1 proposes a cylinder block configured such that pillar portion, which couples an upper deck with a lower deck, is provided between an ignition plug mounting hole and a plane including two adjacent head bolt through holes. In the cylinder head disclosed in Patent Document 1, the pillar portions are provided so that the stress around each ignition plug is relieved, while ensuring the cooling performance around the ignition plugs.

Patent Document 2 discloses a cylinder head in which head bolt bosses are connected to intake and exhaust ports by a thickened portion provided in a lower deck to increase the rigidity of the lower deck. Patent Document 3 discloses a cylinder head in which ribs that connect upstream openings of exhaust ports with each other are provided on an upper surface of a lower deck to increase the rigidity of the lower deck.

PRIOR ART DOCUMENTS

Patent Documents

Patent Document 1: Japanese Laid-Open Patent Publication No. 2009-264260

Patent Document 2: Japanese Laid-Open Patent Publication No. 2004-218481

Patent Document 3: Japanese Laid-Open Patent Publication No. 2000-310157

SUMMARY OF THE INVENTION

Problems that the Invention is to Solve

During the operation of an internal combustion engine, as shown in FIG. 6, the top surface portion of each combustion chamber in which an ignition plug mounting hole 50 is formed is pushed up by the cylinder internal pressure. Tensile stress in a direction spreading an intake port 51 and an exhaust port 52 from the ignition plug mounting hole 50 may be generated so that the stress concentrates on the surroundings of the ignition plug mounting hole 50.

In this respect, in the cylinder head disclosed in above Patent Document 1, merely opposite ends of the head are reinforced. Accordingly, it is considered that the relief of the stress around the ignition plug is not sufficient. It is considered that the number of the columnar portions is increased to ensure sufficient strength. Such a case leads an increase of the weight of the cylinder head.

In recent years, there has been turbo-downsizing of internal combustion engines, in which the displacement is reduced by ensuring the maximum output by forced induction using a turbocharger. In such an internal combustion engine, due to the expansion of the forced induction range, a high cylinder internal pressure is generated in a broad operation range so that the environment that surrounds the cylinder head is severe in terms of the heat and the strength.

An object of the present invention is to provide a cylinder head for an internal combustion engine that can limit deformation of the cylinder head due to cylinder internal pressure and advantageously relieve stress concentration around a mounting hole for a member such as an ignition plug accompanying the deformation.

Means for Solving the Problems

To achieve the above described object, a cylinder head for an internal combustion engine including an intake port, an exhaust port, a mounting hole for mounting a member to be cooled, and a water jacket provided around the mounting hole is provided. The rigidity of a portion around the water jacket is higher in a portion between the mounting hole and at least one of the intake port and the exhaust port than in the remaining portion around the mounting hole.

According to the above described configuration, the rigidity of the portion between the intake port and the mounting hole and/or the portion between the exhaust port and the mounting hole is increased. In the portion with the increased rigidity, tensile stress in a direction spreading outward is generated by the upward force applied to the top surface portion of the combustion chamber due to the cylinder internal pressure. Accordingly, the deformation of the cylinder head due to the cylinder internal pressure is limited so that the stress concentration around the mounting hole accompanying the deformation is advantageously relieved.

To achieve the above described object, a cylinder head for an internal combustion engine including an intake port, an exhaust port, a mounting hole for mounting a member to be cooled, and a water jacket provided around the mounting hole is provided. In a portion around the water jacket, a portion between the mounting hole and at least one of the intake port and the exhaust port is reinforced to increase the rigidity thereof.

According to the above described configuration, the rigidity of the portion between the intake port and the mounting hole and/or the portion between the exhaust port and the mounting hole is increased. In the portion with the increased rigidity, tensile stress in a direction spreading outward is generated by the upward force on the top surface portion of the combustion chamber due to the cylinder internal pressure. Accordingly, the deformation of the cylinder head due to the cylinder internal pressure is limited so that the stress concentration around the mounting hole accompanying the deformation is advantageously relieved.

The above reinforcement is performed by setting an upper surface of the water jacket to be lower in a portion between the mounting hole and at least one of the intake port and the exhaust port than in the remaining portion around the mounting hole, or thickening a wall surface around the water jacket.

To achieve the above described object, a cylinder head for an internal combustion engine including an intake port, an exhaust port, a mounting hole for mounting a member to be cooled, and a water jacket provided around the mounting hole is provided. An upper surface of the water jacket is set to be lower in a portion between the mounting hole and at least one of the intake port and the exhaust port than in the remaining portion around the mounting hole.

According to the above described configuration, the rigidity of the portion between the intake port and the mounting hole and/or the portion between the exhaust port and the mounting hole is increased by lowering the upper surface of the water jacket. In the portion with the increased rigidity, tensile stress in a direction spreading outward is generated by the upward force on the top surface portion of the combustion chamber due to the cylinder internal pressure. Accordingly, the deformation of the cylinder head due to the cylinder internal pressure is limited so that the stress concentration around the mounting hole accompanying the deformation is advantageously relieved.

To achieve the above described object, a cylinder head for an internal combustion engine including an intake port, an exhaust port, a mounting hole for mounting a member to be cooled, and a water jacket provided around the mounting hole is provided. A wall surface of the water jacket is thickened in a portion between the mounting hole and at least one of the intake port and the exhaust port.

According to the above described configuration, the rigidity of the portion between the intake port and the mounting hole and/or the portion between the exhaust port and the mounting hole is increased by thickening the wall surface of the water jacket. In the portion with the increased rigidity, tensile stress in a direction spreading outward is generated by the upward force on the top surface portion of the combustion chamber due to the cylinder internal pressure.

Accordingly, the deformation of the cylinder head due to the cylinder internal pressure is limited so that the stress concentration around the mounting hole accompanying the deformation is advantageously relieved.

MODES FOR CARRYING OUT THE INVENTION

First Embodiment

Hereinafter, a cylinder head for an internal combustion engine according to a first embodiment of the present invention will be described with reference to FIGS. 1 to 4. The cylinder head of the present embodiment is applied to an in-line four cylinder internal combustion engine.

Figure 1:
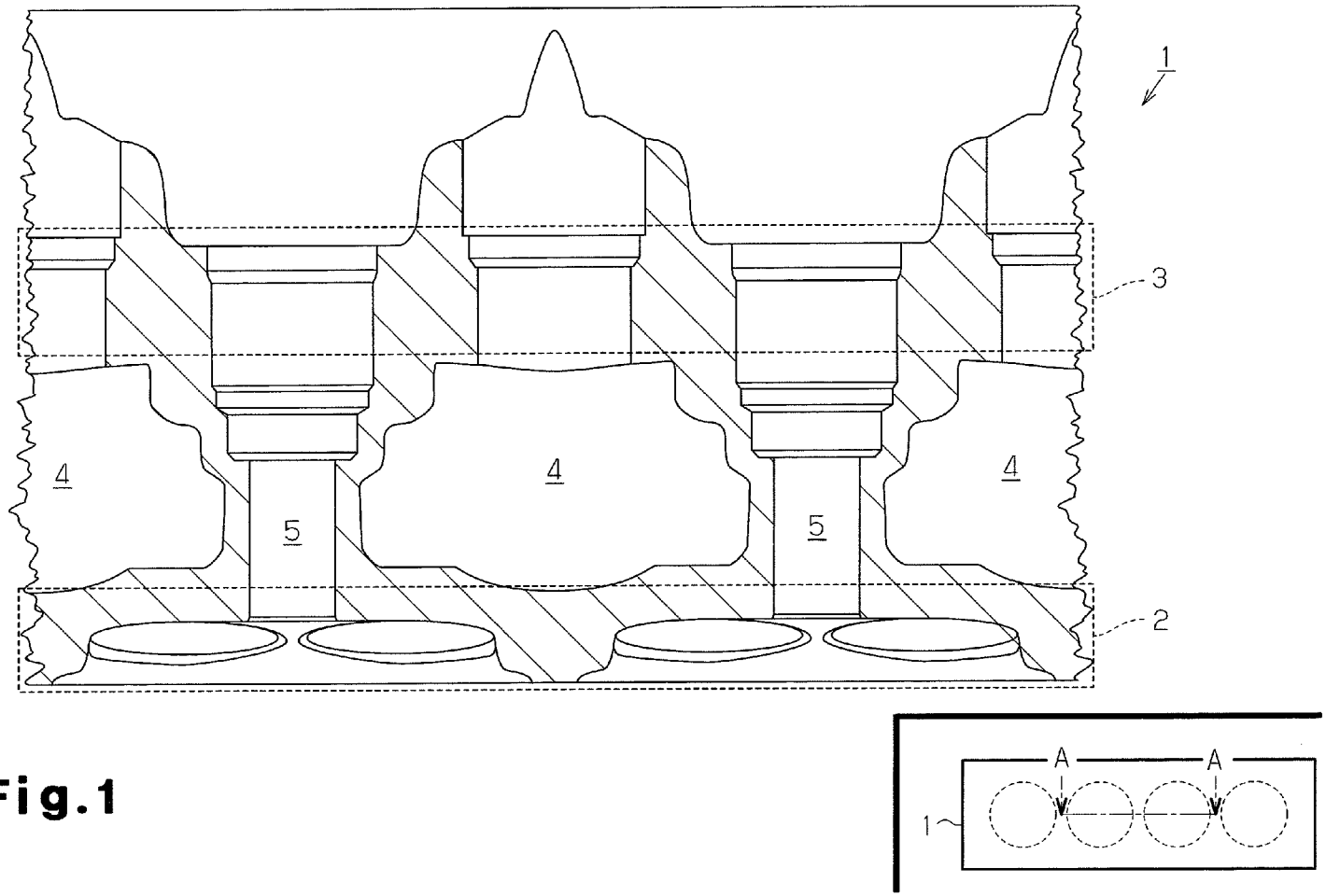
FIG. 1 is a cross-sectional view taken along a line A-A in a schematic plan view shown in bottom right of FIG. 1, illustrating a sectional structure of a cylinder head for an internal combustion engine according to a first embodiment of the present invention.

As shown in FIG. 1, the inside of a cylinder head 1 is configured to have a two-layer structure with two decks, namely a lower deck 2 and an upper deck 3. A water jacket 4, through which cooling water flows, is provided between the lower deck 2 and the upper deck 3.

Figure 2:
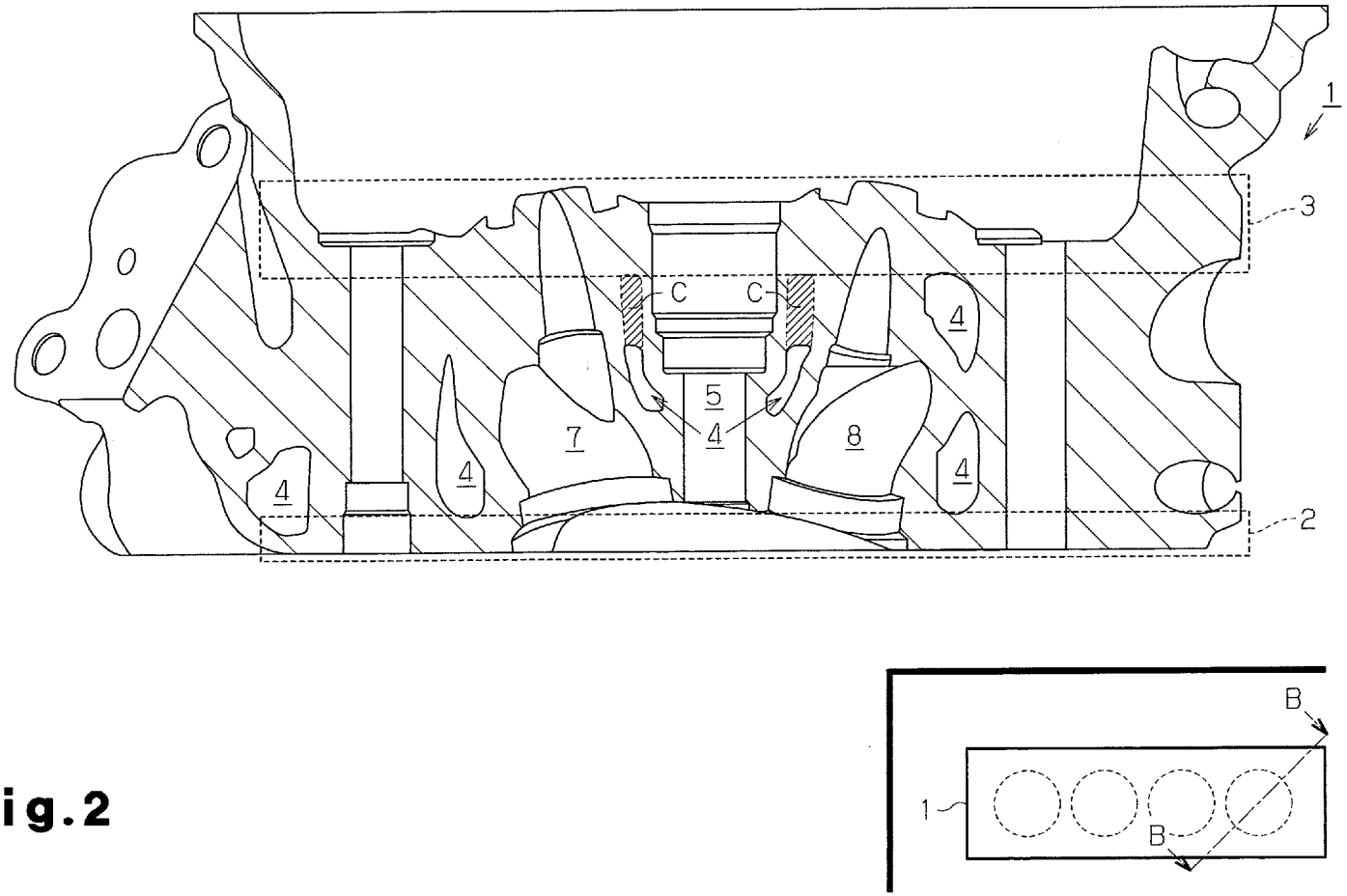
FIG. 2 is a cross-sectional view taken along a line B-B in a schematic plan view shown in bottom right of FIG. 2, illustrating the sectional structure of the cylinder head according to the first embodiment.

As shown in FIG. 2, an ignition plug mounting hole 5, to which an ignition plug as a member to be cooled is mounted, and ports, which are intake ports 7 and exhaust ports 8, are provided in the lower portion of the cylinder head 1. In the cylinder head 1, one ignition plug mounting hole 5, a pair of the intake ports 7, and a pair of the exhaust ports 8 are provided in each cylinder.

Figure 3:
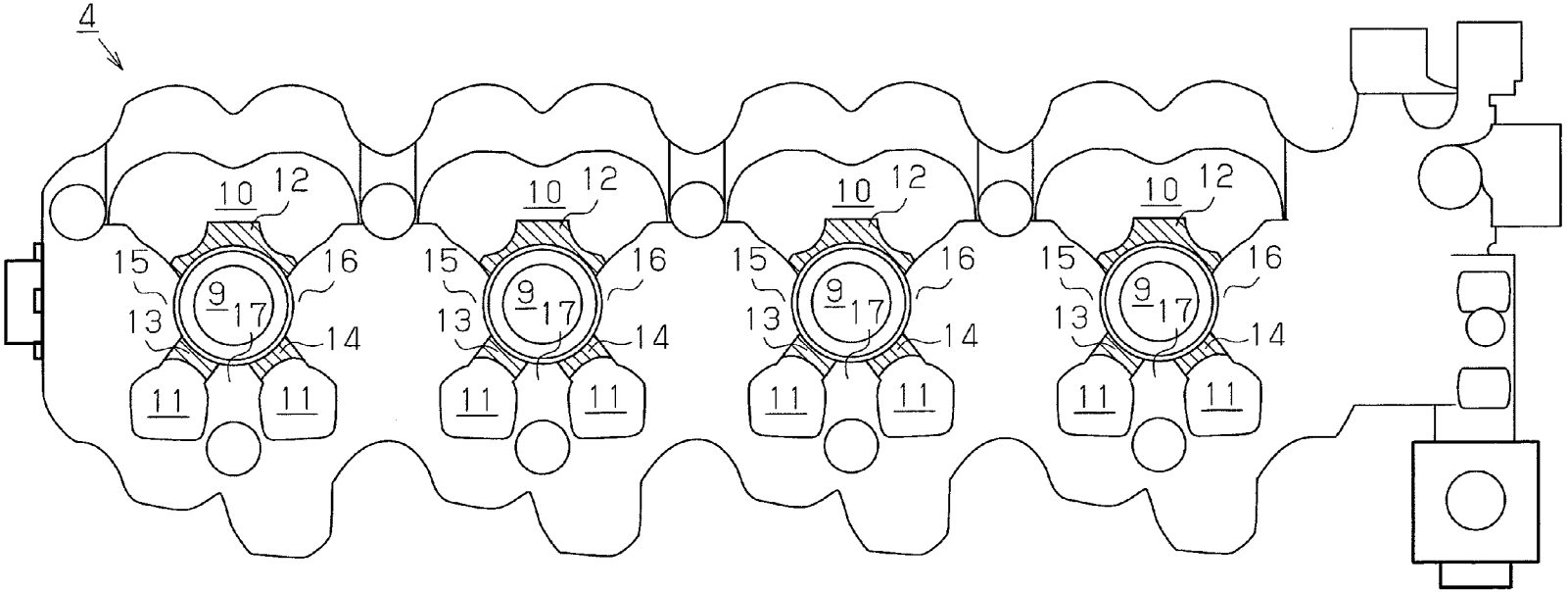
FIG. 3 is a top plan view illustrating a planar structure of a water jacket formed in the cylinder head according to the first embodiment.
Figure 4:
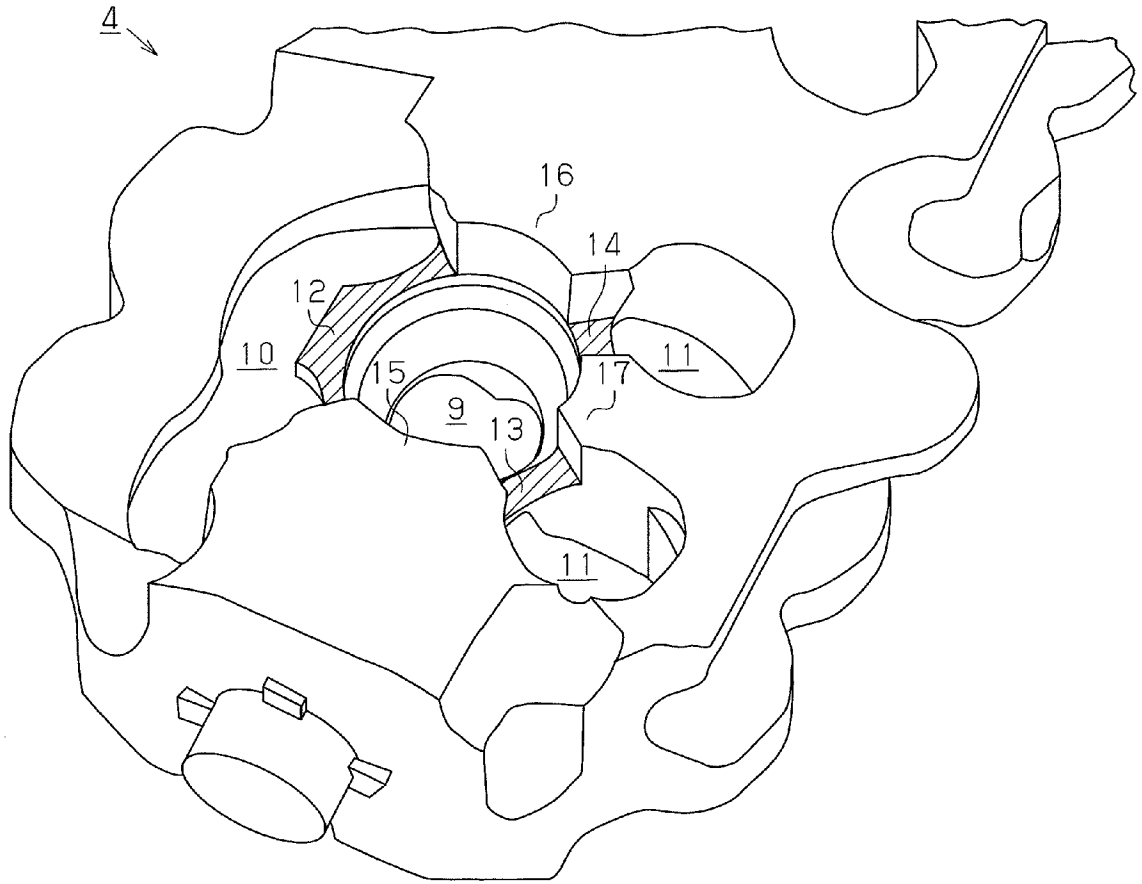
FIG. 4 is a perspective view partially illustrating a perspective structure of the water jacket formed in the cylinder head according to the first embodiment.

In the cylinder head 1, the water jacket 4 shaped as shown in FIGS. 3 and 4 is provided. The water jacket 4 is provided such that the water jacket 4 avoids portions 9 corresponding to the ignition plug mounting holes 5, portions 10 corresponding to the intake ports 7, and portions 11 corresponding to the exhaust ports 8.

As shown in FIG. 4, in the cylinder head 1, upper surfaces 12 to 14 of the portions of the water jacket 4 between the intake ports 7 and the ignition plug mounting hole 5 and between the exhaust ports 8 and the ignition plug mounting hole 5 are formed lower than upper surfaces 15 to 17 of the other portions of the water jacket 4 around the ignition plug mounting hole 5 by one step. Thereby, the portions between the intake ports 7 and the ignition plug mounting hole 5 and between the exhaust ports 8 and the ignition plug mounting hole 5 are reinforced so that the rigidity of the portions around the water jacket 4 is increased. The cylinder head 1 of the present embodiment corresponds to a conventional cylinder head shown by a dashed line in FIG. 2 with a similar water jacket from which a portion C shown by a hatched line in FIG. 2 is removed.

Next, the operation of the cylinder head 1 as above configured will be described.

In the internal combustion engine with the cylinder head 1 according to the present embodiment, the lower surface of the cylinder head 1 corresponding to the top surface of the combustion chambers is pushed up by the cylinder internal pressure generated by combustion as well. According to the pushing up, tensile stress in a direction spreading the intake ports 7 and the exhaust ports 8 outward about each ignition plug mounting hole 5 is generated. In the cylinder head 1, the rigidity of the portions between the intake ports 7 and the ignition plug mounting hole 5 and between the exhaust ports 8 and the ignition plug mounting hole 5 is improved so that the deformation of the cylinder head 1 at this time is limited. As a result, the stress concentration around each ignition plug mounting hole 5 when the cylinder internal pressure is applied is relieved.

The present embodiment described above has the following advantages.

(1) In the present embodiment, around each ignition plug mounting hole 5, the upper surfaces 12 to 14 of the portions of the water jacket 4 between the intake ports 7 and the ignition plug mounting hole 5 and between the exhaust ports 8 and the ignition plug mounting hole 5 are formed lower than the upper surfaces 15 to 17 of the other portions of the water jacket 4 around the ignition plug mounting hole 5. Thereby, the portions around the water jacket 4 between the intake ports 7 and the ignition plug mounting hole 5 and between the exhaust ports 8 and the ignition plug mounting hole 5 are reinforced so that the rigidity thereof is increased. Accordingly, the deformation of the cylinder head 1 due to the cylinder internal pressure is limited so that the stress concentration around each ignition plug mounting hole 5 accompanying the deformation is advantageously relieved.

(2) According to the present embodiment, the water jacket 4 is left around the lower portion of each ignition plug mounting hole 5 in the vicinity of the corresponding combustion chamber, while increasing the rigidity.

Accordingly, the rigidity around the ignition plug mounting hole 5 is increased to relieve the stress concentration around the ignition plug mounting hole 5, while maintaining the cooling performance of portions facing the combustion chambers, which are heated to a high temperature.

(3) In the present embodiment, the upper surfaces 12 to 14 of the portions of the water jacket 4 between the intake ports 7 and the ignition plug mounting hole 5 and between the exhaust ports 8 and the ignition plug mounting hole 5 are formed lower, while maintaining the upper surface 17 of the portion of the water jacket 4 between the exhaust ports 8 high. Accordingly, the rigidity around the ignition plug mounting hole 5 is increased to relieve the stress concentration around the ignition plug mounting hole 5, while maintaining the cooling performance of the portion between the exhaust ports 8 that is heated to a high temperature.

Second Embodiment

Next, a cylinder head for an internal combustion engine according to a second embodiment of the present invention will be described with reference to FIG. 5. The cylinder head of the present embodiment corresponds to the cylinder head of the first embodiment in which the shape of the water jacket formed around the ignition plug mounting holes 5 is changed. In the present embodiment, the same reference numerals are given to parts that are common with those of the first embodiment and a detailed description thereof will be omitted.

Figure 5:
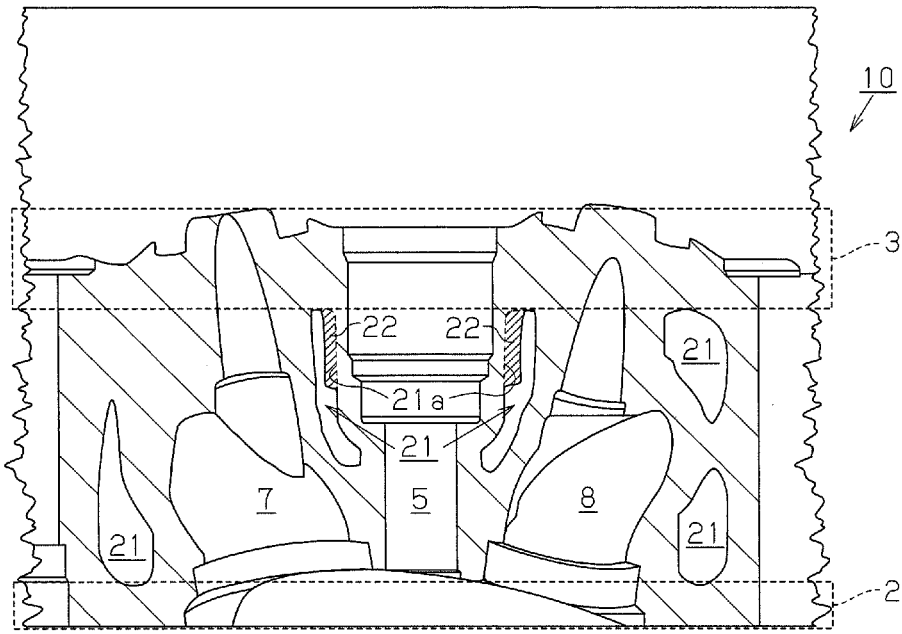
FIG. 5 is a cross-sectional view illustrating a sectional structure of a cylinder head for an internal combustion engine according to a second embodiment of the present invention.
Figure 6:
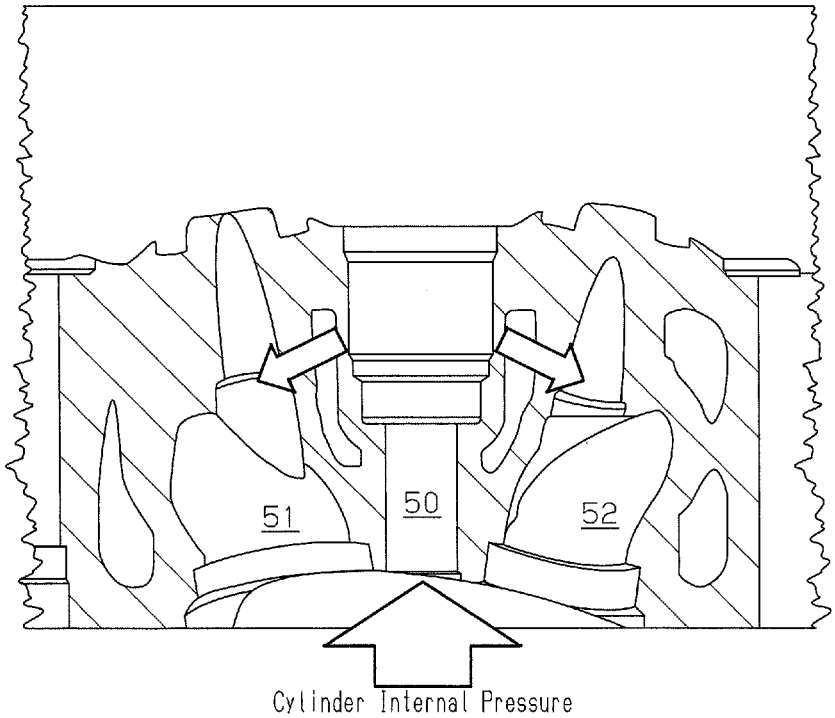
FIG. 6 is a cross-sectional view illustrating a manner in which tensile stress in accordance with a cylinder internal pressure acts in a conventional cylinder head for an internal combustion engine.

As shown in FIG. 5, a water jacket 21 is formed in a cylinder head 20 of the present embodiment such that cooling water passes through the surroundings of each ignition plug mounting hole 5 as well. However, in the present embodiment, upper surfaces of portions of the water jacket 21 between the intake ports 7 and the ignition plug mounting hole 5 and between the exhaust ports 8 and the ignition plug mounting hole 5 are formed as high as upper surfaces of the other portions of the water jacket 21 around the ignition plug mounting hole 5.

In the cylinder head 20 of the present embodiment, wall surfaces 21*a* of the water jacket 21 on an inner peripheral side between the intake ports 7 and the ignition plug mounting hole 5 and between the exhaust ports 8 and the ignition plug mounting hole 5 are thickened to be reinforced. Portions 22 shown by hatched lines in FIG. 5 correspond to the thickened portions.

Next, the operation of the cylinder head 20 as above configured will be described.

In the cylinder head 20 of the present embodiment, when the cylinder internal pressure operates, the portions around the ignition plug mounting holes 5 immediately above the combustion chambers are pushed up to be deformed such that the intake ports 7 and the exhaust ports 8 spread outward from the ignition plug mounting hole 5. In the cylinder head 20, the thickened portions 22 are formed to increase the rigidity of the portions between the intake ports 7 and the ignition plug mounting hole 5 and between the exhaust ports 8 and the ignition plug mounting hole 5. Accordingly, in the cylinder head 20, the deformation due to the cylinder internal pressure is limited, and the stress concentration around the ignition plug mounting holes 5 accompanying the deformation is relieved as well.

The present embodiment described above has the following advantages.

(4) According to the present embodiment, the wall surfaces of the portions of the water jacket 4 between the intake ports 7 and the ignition plug mounting hole 5 and between the exhaust ports 8 and the ignition plug mounting hole 5 are thickened. Thereby, the portions around the water jacket 4 in the regions thereof between the intake ports 7 and the ignition plug mounting hole 5 and between the exhaust ports 8 and the ignition plug mounting hole 5 are reinforced so that the rigidity thereof is increased. Accordingly, the stress concentration around the ignition plug mounting hole 5 due to the cylinder internal pressure is advantageously relieved.

(5) According to the present embodiment, thickening for reinforcing the wall surfaces of the water jacket 21 is performed at the upper portions of the water jacket 21. Accordingly, the water jacket 21 is left in the regions in the vicinity of each combustion chamber without reducing the area of the flow passage, while increasing the rigidity of the portions between the intake ports 7 and the ignition plug mounting hole 5 and between the exhaust ports 8 and the ignition plug mounting hole 5 so that the cooling performance in the regions facing the combustion chamber to be heated to a high temperature is maintained.

The above described embodiments may be modified as follows.

In the second embodiment, the portions of the water jacket 21 on the internal peripheral side between the intake ports 7 and the ignition plug mounting hole 5 and between the exhaust ports 8 and the ignition plug mounting hole 5 are thickened. Alternatively, the portions of the water jacket 21 on the outer peripheral side may be thickened.

In the second embodiment, the upper portions of the water jacket 21 between the intake ports 7 and the ignition plug mounting hole 5 and between the exhaust ports 8 and the ignition plug mounting hole 5 are thickened. Alternatively, the lower portions of the water jacket 21 may be thickened as well if it is necessary to ensure the rigidity for relieving the stress concentration. It is desirable that the area of the flow passage of the lower portion of the water jacket 21 be widened to ensure the cooling performance. Accordingly, even in the case where it is necessary to thicken the water jacket 21 from the upper portion to the lower portion thereof, it is desirable that the amount of thickening the lower portion be decreased, while increasing the amount of thickening the upper portion to form the water jacket 21 to have a wider width toward the lower portion.

In the above described embodiments, the upper surfaces of the water jacket are lowered or the wall surfaces of the water jacket are thickened to increase the rigidity of the portions around the water jackets 4 and 21 between the intake ports 7 and the ignition plug mounting hole 5 and between the exhaust ports 8 and the ignition plug mounting hole 5. Regarding the reinforcement for increasing the rigidity of such portions, other reinforcing methods such as providing beam or ribs, for example, or forming such portions around the water jackets 4 and 21 with materials having a higher rigidity than that of other portions thereof may be used.

In the above described embodiments, both of the portions between the ignition plug mounting hole 5 and the intake ports 7 and between the ignition plug mounting hole 5 and the exhaust ports 8 are reinforced. The reinforcement of any one of the portions may be omitted as long as the stress concentration can be sufficiently relieved.

In the above described embodiments, the ignition plug mounting holes 5 to which the ignition plugs are mounted are formed. In a diesel engine, for example, injectors are mounted on the cylinder head in place of the ignition plugs in some cases. Even in such a case, the stress concentration around an injector mounting hole is relieved by reinforcing the portion around the water jacket between the injector mounting hole and at least one of the intake ports and the exhaust ports. In this case, the injector serves as a member to be cooled.

In the above described embodiments, a pair of the intake ports 7 and a pair of the exhaust ports 8 are provided in each cylinder. The number and the arrangement of the intake ports 7 and the exhaust ports 8 are not limited to this, and may be appropriately changed.

In the above described embodiments, the case where the present invention is applied to the in-line four cylinder internal combustion engine is described. The present invention may be applied to internal combustion engines with other cylinder arrays.

DESCRIPTION OF THE REFERENCE NUMERALS

1 . . . Cylinder Head, 2 . . . Lower Deck, 3 . . . Upper Deck, 4 . . . Water Jacket, 5 . . . Ignition Plug Mounting Hole (Mounting Hole for Mounting Member to be Cooled), 7 . . . Intake Port, 8 . . . Exhaust Port, 9 . . . Portion through which Ignition Plug Mounting Hole Passes, 10 Portion through which Intake Port Passes, 11 . . . Portion through which Exhaust Port Passes, 12 to 14 . . . Upper Surfaces (of Portions of Water Jacket between Intake Port and Ignition Plug Mounting Hole and between Exhaust Port and Ignition Plug Mounting Hole), 15 to 17 . . . Upper Surfaces (of Other Portions of Water Jacket around Ignition Plug Mounting Hole), 20 . . . Cylinder Head, 21 . . . Water Jacket, 21*a* . . . Wall Surface of Water Jacket, 22 . . . Thickened Portion, 50 . . . Ignition Plug Mounting Hole, 51 . . . Intake Port, and 52 . . . Exhaust Port.

The invention claimed is:

1. A cylinder head for an internal combustion engine comprising an intake port, exhaust ports, a mounting hole for mounting a member to be cooled, and a water jacket provided around the mounting hole, wherein the cylinder head is configured such that the intake port, the exhaust ports and the mounting hole are provided to correspond to one cylinder, and for the one cylinder, at least one of an upper surface of a portion of the water jacket between the intake port and the mounting hole and an upper surface of a portion of the water jacket between each exhaust port and the mounting hole is set to be lower than an upper surface of a portion of the water jacket between the exhaust ports.

2. A cylinder head for an internal combustion engine comprising an intake port, exhaust ports, a mounting hole for mounting a member to be cooled, and a water jacket provided around the mounting hole, wherein the cylinder head is configured such that the intake port, the exhaust ports and the mounting hole are provided to correspond to one cylinder, and for the one cylinder, at least one of an upper surface of a portion of the water jacket between the intake port and the mounting hole and an upper surface of a portion of the water jacket between each exhaust port and the mounting hole is set to be lower than an upper surface of a portion of the water jacket between the exhaust ports and an upper surface of a portion of the water jacket between the intake port and each exhaust port.

* * * * *